US005908213A

United States Patent [19]

Tippetts et al.

[11] Patent Number: 5,908,213

[45] Date of Patent: Jun. 1, 1999

[54] ELASTIC DOOR LOCKING DEVICE

[76] Inventors: David R. Tippetts, 2124 Addison, Houston, Tex. 77030; Robert T. Parks, 6249 Meadowlake, Houston, Tex. 77057

[21] Appl. No.: 08/726,980

[22] Filed: Oct. 7, 1996

[51] Int. Cl.[6] ..... E05C 19/10

[52] U.S. Cl. ..... 292/246; 292/288

[58] Field of Search ..... 292/246, 250, 292/288, 289, 258; 24/129 D, 17 B, 16 PB, 20 EE, 20 R, 17 AP; 248/60, 62, 69; 206/805; 70/93

[56] References Cited

U.S. PATENT DOCUMENTS

| | | | |
|---|---|---|---|
| 181,925 | 9/1876 | Edelen . | |
| 765,658 | 7/1904 | Beseler . | |
| 2,151,587 | 3/1939 | Cassileth | 292/288 |
| 2,229,129 | 1/1941 | Riegelman | 292/62 |
| 2,470,706 | 5/1949 | Larson . | |
| 2,899,229 | 8/1959 | Jenks | 292/288 |
| 3,012,806 | 12/1961 | Ellis | 292/288 |
| 3,804,454 | 4/1974 | Simmons | 292/246 |
| 4,095,830 | 6/1978 | Spellman | 292/288 |
| 4,281,865 | 8/1981 | Nicholson | 292/246 |
| 4,288,119 | 9/1981 | Geiger | 292/262 |
| 4,324,438 | 4/1982 | Speedle | 248/73 |
| 4,407,478 | 10/1983 | Hodges | 248/62 |
| 4,478,442 | 10/1984 | Martin | 292/246 |
| 4,629,229 | 12/1986 | Correnti et al. | 292/246 |
| 4,689,858 | 9/1987 | Barber | 24/17 B |
| 4,715,629 | 12/1987 | Robinson | 292/256 |
| 4,811,454 | 3/1989 | Crook | 292/246 |
| 5,195,561 | 3/1993 | Wilson | 138/89.2 |
| 5,344,107 | 9/1994 | Lee | 248/60 |
| 5,387,018 | 2/1995 | Pinkerton | 292/259 R |
| 5,466,022 | 11/1995 | Derman | 292/246 |
| 5,517,838 | 5/1996 | Moore | 24/16 PB |
| 5,522,122 | 6/1996 | Turchick | 24/335 |
| 5,522,571 | 6/1996 | Simmons | 248/60 |
| 5,573,165 | 11/1996 | Bloemer | 224/523 |

FOREIGN PATENT DOCUMENTS

| | | |
|---|---|---|
| 564719 | 2/1958 | Belgium . |

*Primary Examiner*—Steven Meyers
*Assistant Examiner*—Gary Estremsky
*Attorney, Agent, or Firm*—Arnold White & Durkee

[57] ABSTRACT

A removable door locking device having a strong, flexible, resilient, elastic loop capable of absorbing instantaneous force applied to the door. One end of the loop fits tightly around the door knob and the other end of the loop has multiple attachment points to a wall member for adjustment of tightness.

11 Claims, 3 Drawing Sheets

ELASTIC DOOR LOCKING DEVICE

BACKGROUND OF THE INVENTION

1. Field of the Invention

The present invention relates generally to mechanisms for locking doors in homes or buildings. More specifically, the present invention relates to an elastic door locking device which may be installed between a door knob and the wall adjacent the door, to absorb instantaneous impact of attempted forced entry.

2. Description of Related Art

In recent years, home intruders have become increasingly aggressive in their efforts to enter dwellings through locked doors. For example, recently intruders referred to as "kick burglars" have kicked or otherwise applied sufficient force on locking mechanisms to cause one or more of the locking components or door structure to fail. This trend of criminal activity in gaining access to the interior of a home or dwelling relies on the element of surprise, because the occupants are unable to react quickly enough to flee, contact police or other authorities, or take defensive measures.

In the past, primary and secondary locks have not been designed in a manner sufficient to absorb the impact of "kick burglars." First, the currently available primary and secondary locks are rigid, in that they are composed primarily of components which are unable to absorb the instantaneous forces imposed on the door and locking components. Additionally, because the current locking systems are fastened to the door and door frame by relatively short screws or other attachment means, they become dislodged if the door trim and/or door frame is shattered.

When an intruder kicks or otherwise applies instantaneous peak force to a door, current locking systems will fail in one of several ways. For example, the bolt on the typical dead bolt or keyless dead bolt will break through the door frame and door trim. Also, a secondary lock composed of a rigid metal or chain will reach the point where the maximum tensile strain on the metal and/or the frame is exceeded, and it will simply break. Additionally, screws which attach secondary locking devices to either the door itself or the door frame will be dislodged and ripped out of the door or its frame by the instantaneous force applied.

In the past, various door locking devices have been proposed which can be applied between the door knob and the adjacent wall to prevent the door from being opened from the outside. For example, U.S. Pat. No. 4,629,229 (Correnti, et al.) shows a flexible cable forming a loop on which a sleeve is positioned for engagement around a door knob. A loop of the cable is extended to slip over the sleeve and is then tightened to hold the door closed tightly. According to the '229 patent, the flexible cable is made of steel or the like, preferably covered by a plastic sheath. The cable is fastened to a wall stud with a screw or, in an alternative embodiment, with a fastener which grips the cable between upper and lower jaws which are attached to the wall stud. U.S. Pat. No. 4,288,119 (Geiger) shows a door locking cable which includes a flexible member which is looped around the door knob. The other end of the cable is secured to the door frame by a screw or bolt. According to the '119 patent, the cable is a multi strand steel cable which may be sheathed within a resilient material such as polyvinyl chloride. U.S. Pat. No. 5,466,022 (Derman) relates to a safety cable lock for knob operated door, which includes a plastic covered wire cable which loops around the door knob, and a screw or bolt in the frame stud to anchor the cable.

A number of devices also have been suggested to child-proof doors or cabinets, several of which involve an elastic component. U.S. Pat. No. 2,899,229 (Jenks) shows a child-proof cabinet lock which includes a coil spring extending between two adjacent door knobs. Similarly, U.S. Pat. No. 2,151,857 (Cassileth) shows a door handle lock extending between two adjacent door knobs. U.S. Pat. No. 3,012,806 (Ellis) shows a vehicle door safety cord which extends between the rear doors of automobiles. U.S. Pat. No. 4,281,865 (Nicholson) shows an interior door security lock with a horizontally extended wire which is slipped over the door knob. U.S. Pat. No. 4,715,629 (Robinson) relates to a child-proof closure device which includes a strap-like part which is non-elastic and a central elastic or spring loaded portion intermediate the strap. U.S. Pat. No. 5,387,018 (Pinkerton) relates to a child-proof refrigerator door latch which includes a shock cord mounted between two adhesive mounting plates.

The prior art fails to show an elastic door locking device capable of absorbing the instantaneous impact of "kick burglars" to prevent such intrusions.

SUMMARY OF THE INVENTION

The invention utilizes a strong, flexible, resilient elastic loop capable of absorbing instantaneous force applied to a door. The elastic loop preferably is constructed of rubber or urethane. One end of the loop fits over the interior door knob. The other end of the loop has multiple attachment points for adjustment, which are attached to an anchor in the wall adjacent to the door knob or to a support stud adjacent the door frame.

One advantage of the invention is that the loop can stretch and has sufficient resiliency and elasticity to prevent shattering of a wood door frame or trim. Another advantage of the present invention is that the initial force applied to a door will be absorbed by the elasticity of the loop material and, as a result, prevent excessive force from causing the rigid lock, door or door frame components to break. A third advantage of the present invention is that the door will quickly rebound when it is pushed open, due to the resilient, elastic material of the loop. Another advantage of the present invention is that the peak force required to break the locking device cannot be obtained because force applied to the door is absorbed by the elastic loop. Another advantage of the present invention is that it allows the occupant of a dwelling to have sufficient time to prepare for an intrusion by contacting the police or authorities, or taking defensive measures.

The following drawings form part of the present specification and are included to further demonstrate certain aspects of the present invention. The invention may be better understood by reference to one or more of these drawings in combination with the detailed description of specific embodiments presented herein.

DETAILED DESCRIPTION OF A PREFERRED EMBODIMENT

Figure 1:
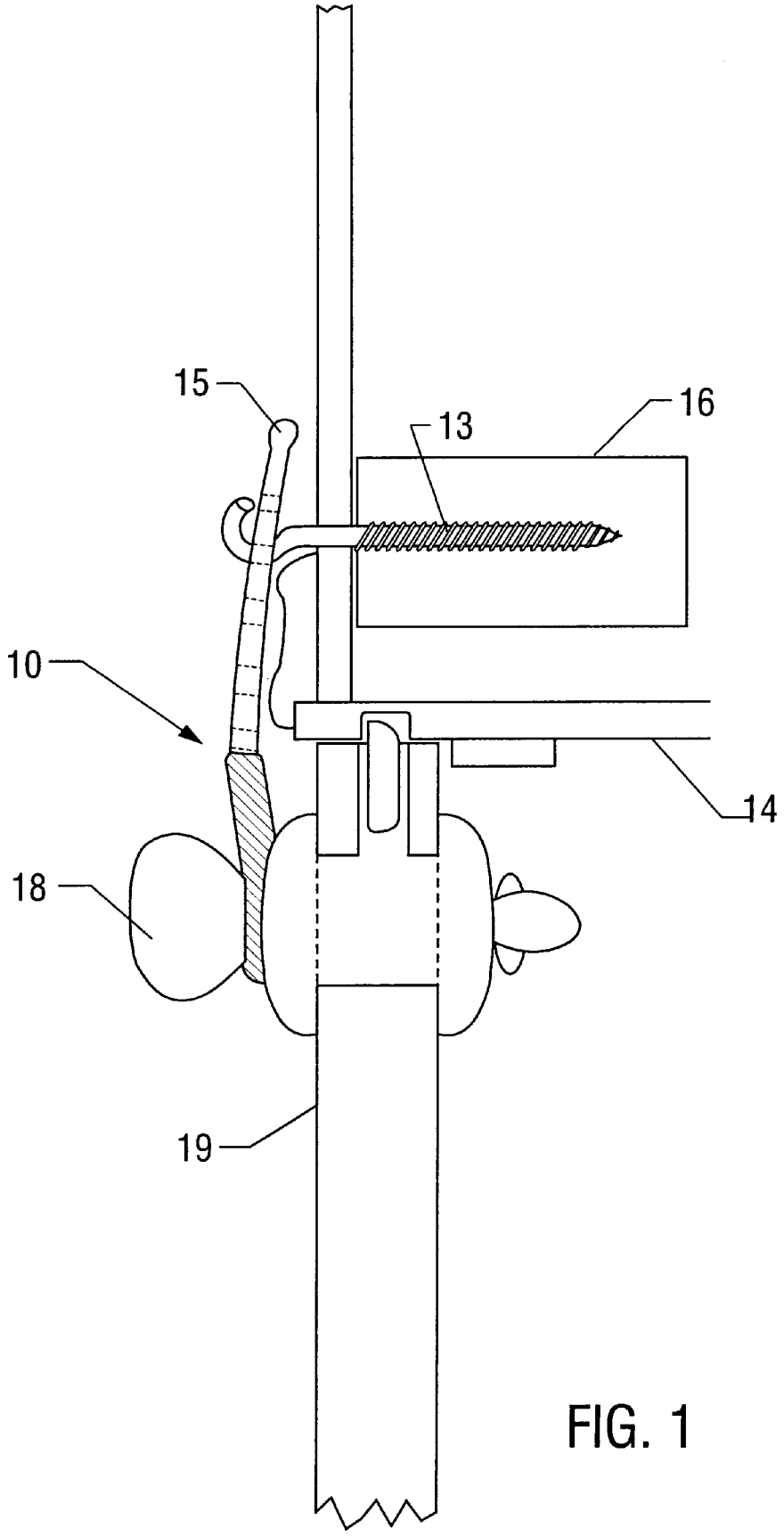
FIG. 1 is a top cross-section view of the claimed invention according to a first embodiment thereof.
Figure 2:
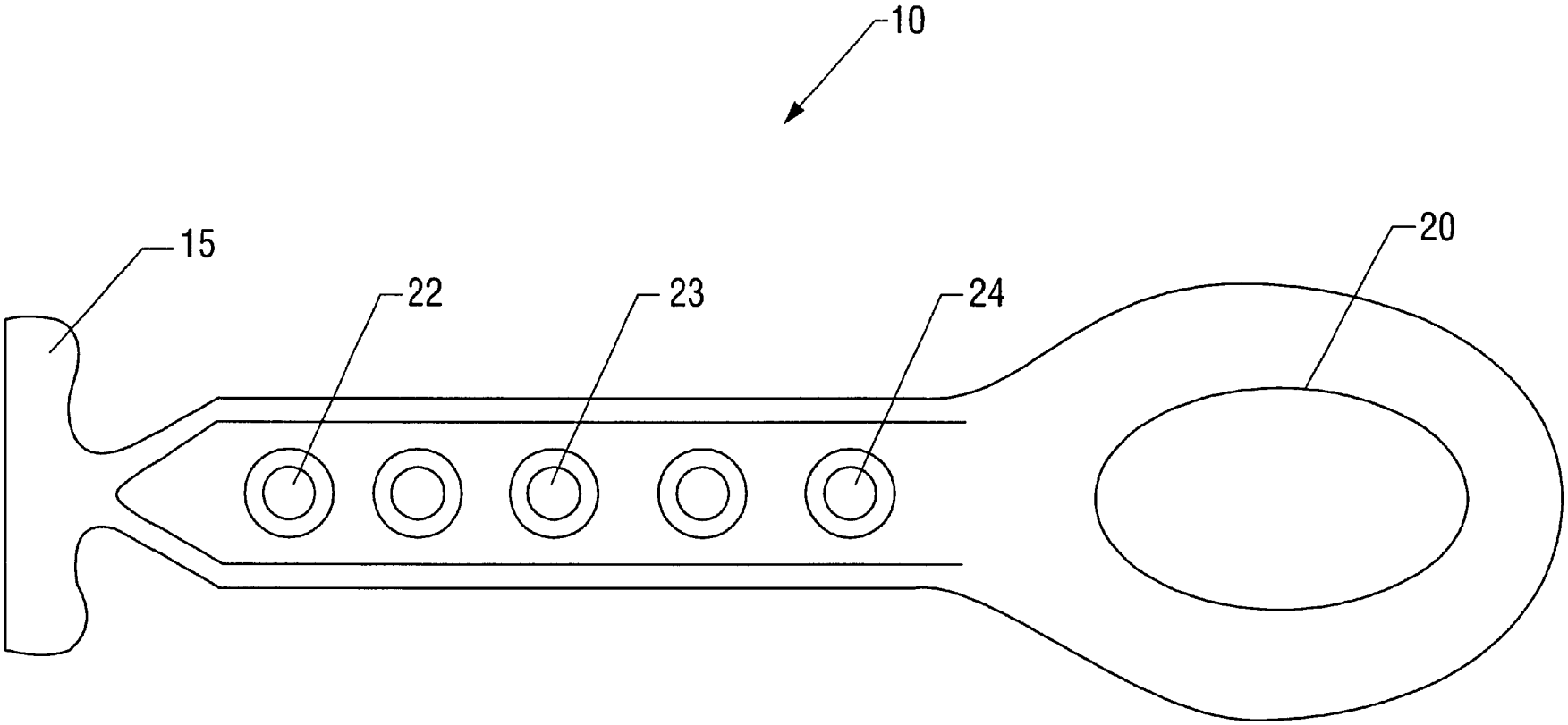
FIG. 2 is a side view of the flexible elastic cable according to the present invention.

Turning now to the drawings and referring initially to FIG. 1, a preferred embodiment of the present invention is shown. The present invention consists of a loop (10) of flexible, stretchable, resilient, elastic material which is preferably rubber or urethane with a strength sufficient to absorb the instantaneous peak force of an impact against the door. The first end of the flexible elastic loop has an aperture or cavity (20) as shown in FIG. 2, dimensioned to fit tightly around the knob (18) of door (19). The size of the loop and/or cavity may be varied, depending on the size of the door and/or door handle. The second end of the loop is attached to an anchoring device (13) which is connected to a stud (16) in the wall of the dwelling adjacent the door frame (14). Preferably, the anchoring device is threaded to the stud and, at its unthreaded end, includes a hook or other member around which the second end of the loop can be repeatably attached and unattached.

Now referring to FIG. 2, the second end of the loop includes multiple attachment points which preferably are holes (22, 23, 24). The multiple attachment points enable adjustment of the locking device in relation to the anchor location and door size, adjustment of the tension on the loop, and variation of the extent to which the door may be opened while the loop is in place. To fasten the loop to anchoring device (13), the second end of the loop includes a handle (15) that may be manually gripped to stretch the loop and hook one of the attachment holes around the anchoring device. Attachment points other than holes may be used, although they also should allow adjustment for door size, tension, and opening desired.

Figure 3A:
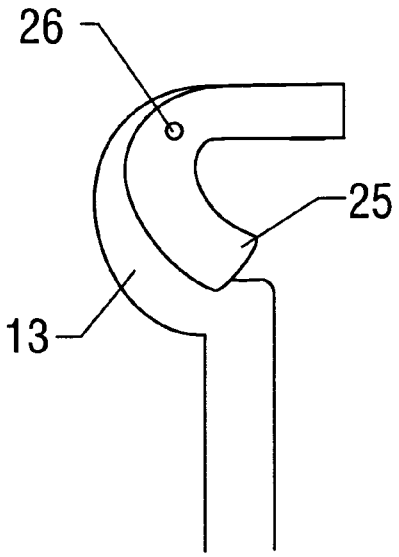
FIG. 3 is a cross-sectional view of a pivoting assembly in the attachment device in one embodiment of the invention, showing the pivoting member (A) in the open position; and (B) in the closed position after tension is applied to the loop.
Figure 3B:
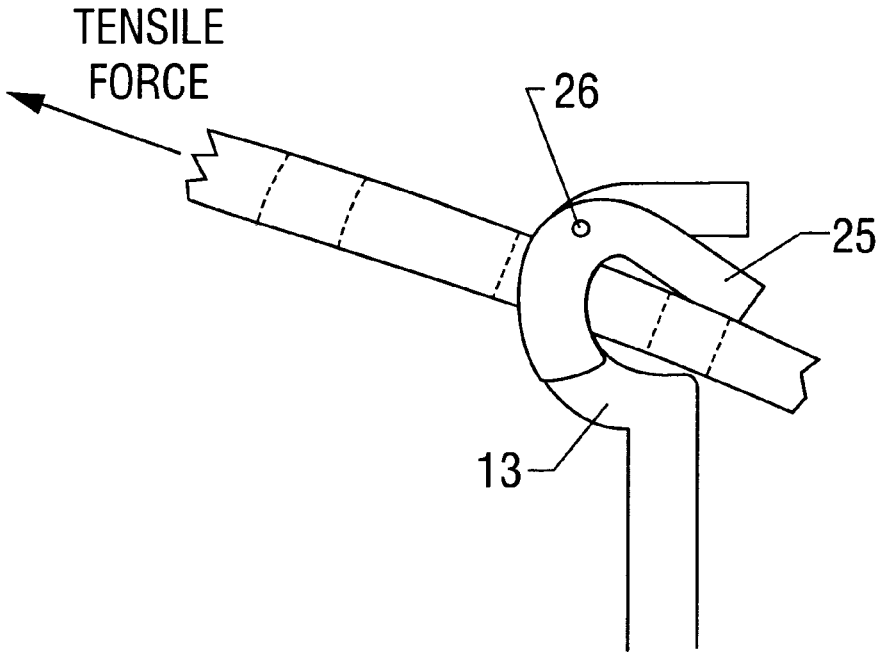

Now referring to FIG. 3, a pivoting assembly is shown which may be used as part of the anchoring device (13). The pivoting assembly helps prevent the attachment holes from slipping off the anchoring device when tension is applied to the loop. As the loop is pulled, the C-shaped pivoting member (25) pivots on hinge (26) until it tightens against the second end of the loop.

Although variations in the embodiment of the present invention may be used without departing from the present invention, certain features may become more important than others in various applications of the invention. The invention, accordingly, should be understood to be limited by the scope of the pending claims.

What is claimed is:

1. A door, stationary member and door locking device comprising:

(a) a door having a door knob adjacent a stationary support member;

(b) an anchoring device affixed to the stationary support member; and (c) a flexible elastic one-piece strap member extending between the door knob and anchoring device, the strap member having a first end with hole means for encircling and securely attaching to the door knob and a second end with a plurality of individual hole means for securely, adjustably attaching to the anchoring device.

2. The door locking device of claim 1 wherein the anchoring device comprises a pivoting member attached thereto, the pivoting member movable between a first position preventing disengagement of the strap member from the anchoring device and a second position allowing manual disengagement of the strap member from the anchoring device.

3. The door locking device of claim 1 further comprising a handle on the second end of the strap member.

4. The door locking device of claim 1 wherein the strap member is made of rubber.

5. The door locking device of claim 1 wherein the strap member is made of urethane.

6. A door and stationary support member in combination with a door locking device for locking a door knob to the stationary support member adjacent the door knob, comprising:

(a) an anchoring device affixed to the stationary support member; and (b) a flexible elastic one-piece strap member extending between the door knob and the anchoring device, the strap member having a first end with hole means encircling and securely attached to the door knob and a second end with a handle and a plurality of individual hole means securely and adjustably engaged to the anchoring device.

7. The device of claim 6 further comprising a pivoting assembly on the anchoring device movable between a first position for preventing disengagement of the individual hole means from the anchoring device and a second position allowing disengagement of the individual hole means from the anchoring device.

8. A door and wall support member in combination with a door locking apparatus attachable between a door knob and the wall support member adjacent thereto, comprising:

(a) anchoring means having a first end screwed into the wall support member and a second end having a pivoting member attached thereto, the pivoting member being manually movable between a first position and a second position; and (b) a flexible elastic one-piece strap member having a first end with hole means encircling and securely attached to the door knob, and a second end having a plurality of separate holes, one of the holes securely and adjustably engaged to the second end of the anchoring means, the pivoting member in the first position preventing disengagement of the hole from the second end of the anchoring means, and in the second position allowing disengagement of the hole from the second end of the anchoring means.

9. The door locking apparatus of claim 8 further comprising a handle on the second end of the strap member.

10. The door locking apparatus of claim 8 wherein the strap member is made of rubber.

11. The door locking apparatus of claim 8 wherein the strap member is made of urethane.

* * * * *